US005847726A

United States Patent [19]

Hori

[11] Patent Number: 5,847,726

[45] Date of Patent: Dec. 8, 1998

[54] INK JET TYPE IMAGE RECORDING APPARATUS HAVING INK PURGING AND FLUSHING MECHANISM CAPABLE OF PROVIDING PROPER PURGING OR FLUSHING TIMING

[75] Inventor: Masaaki Hori, Tajimi, Japan

[73] Assignee: Brother Kogyo Kabushiki Kaisha, Nagoya, Japan

[21] Appl. No.: 610,348

[22] Filed: Mar. 4, 1996

[30] Foreign Application Priority Data

Mar. 15, 1995 [JP] Japan ..... 7-084926

[51] Int. Cl.[6] ..... B41J 2/165

[52] U.S. Cl. ..... 347/23; 347/33; 347/30

[58] Field of Search ..... 347/23, 28, 30, 347/33, 36, 22, 86; 346/1.1

[56] References Cited

U.S. PATENT DOCUMENTS

| | | | |
|---|---|---|---|
| 5,341,163 | 8/1994 | Hanabusa . | |
| 5,530,461 | 6/1996 | Sakuma | 347/23 |
| 5,565,898 | 10/1996 | Sakuma | 347/23 |
| 5,572,242 | 11/1996 | Fuji et al. | 347/23 |

FOREIGN PATENT DOCUMENTS

A-58-128864 8/1983 Japan .

B2-3-59831 9/1991 Japan .

*Primary Examiner*—Peter S. Wong
*Assistant Examiner*—Rajnikant B. Patel
*Attorney, Agent, or Firm*—Oliff & Berridge, PLC

[57] ABSTRACT

An ink jet printer having a print head and connected to a host computer from which imaging data is transmitted to the printer. The printer has a purging mechanism for purging the print head. The host computer has a clock driven by a storage battery or an uninterruptible power supply. The host computer computes a period as a second period by subtracting a completion timing of the latest purging operation from a present time provided by the clock. The ink jet printer stores a first period starting at an electrical power supply timing with respect to the printer or at the operation timing of the purging mechanism after the electrical power supply. If no purging operation has been performed after the electrical power supply, the second period is compared with a predetermined period. If the second period is longer than the predetermined period, purging operation is performed. If purging operation has been performed after the electrical power supply, the first period is compared with the predetermined period. If the first period is longer than the predetermined period, the purging operation is again performed.

37 Claims, 10 Drawing Sheets

INK JET TYPE IMAGE RECORDING APPARATUS HAVING INK PURGING AND FLUSHING MECHANISM CAPABLE OF PROVIDING PROPER PURGING OR FLUSHING TIMING

BACKGROUND OF THE INVENTION

The present invention relates to an ink jet type image recording apparatus having an ink purging mechanism and flushing mechanism, and more particularly, to such printer capable of performing purging and flushing operation at proper intervals.

The ink jet type image recording apparatus is used in a copying machine, a facsimile machine and a printer connected to a personal computer for providing a dot pattern image on an image recording medium such as a paper and a plastic sheet in accordance with transmitted imaging information. A typical ink jet type image recording apparatus is an ink jet printer having a print head in which ink droplets eject from nozzles, fly toward and impinge onto the printing sheet to form an inked image.

In the ink jet printer, bubbles may be generated in an ink in the print head during printing, which leads to insufficient ink ejection. Further, ink droplet, dried ink and paper fibers may be deposited onto an ejection surface of the nozzles to cause clogging against ink flow. Therefore, maintenance and recovery is required in the print head to eliminate such disadvantages. To this effect, is performed conventionally purging in which degraded ink is sucked out from all nozzles of the print head or flushing in which ink in the nozzles is positively discharged by applying internal pressure.

After printing operation, the print head is moved to a position in confrontation with a cap member of a purging mechanism so as to avoid drying of internal ink in the print head for avoiding clogging. In this case, if the printing operation is not performed for long period, ink drying may occur even if the print head is covered by the cap. In this connection, it is necessary to perform purging operation after a desirable time interval from the preceding purging or flushing operation. Incidentally, in the purging operation, the cap is fluidly connected to a pump to apply negative pressure in the print head so as to suck internal dried ink and degraded ink. Therefore, relatively large volume of ink may be discharged out of the print head in purging operation.

In order to control purging operation, Japanese Patent publication No. Hei-3-59831 discloses an ink jet printer in which ink purging operation is performed based on a print command signal and a signal indicating that the ink ejection has not yet been performed after elapse of a predetermined period.

For performing measurement of time period by a timer, electrical power supply to the timer is required. However, if a main switch of the ink jet printer is turned OFF, it becomes impossible to precisely measure the time period during which the printer is in its stand-by state for printing. For example, in the preceding ON state of the ink jet printer, the printer was at its stand-by state for printing so that positive ink flowing does not occur in the print head. With this state, if the main switch is turned OFF, the data of measured time period disappears. Then, the printer is again turned ON, the measurement is newly started. Accordingly, even if the non-printing time period (which is a sum of disappearing time period and newly measured time period) exceeds the threshold level, purging or flushing operation cannot be performed due to reliance on the newly measured time period only.

In order to avoid this problem, other purging operation control has been proposed in that the purging operation is positively performed each time the main switch of the ink jet printer is turned ON, regardless of the non-printing period in the preceding ON period of the printer. However, with this arrangement, by the frequent ON/OFF operation of the ink jet printer, the ink is excessively discharged, that is, unwanted purging may be performed to waste ink. More specifically, through experimental knowledge, purging operation cycle is determined every 10 days taking into the consideration the drying of ink in the print head covered with the cap. However, Electrical power supply cycle or ON/OFF cycle in the ink jet printer may be every half a day. Therefore, in this method, the purging operation is performed everyday, which waste ink.

To avoid the above described drawback, a power storage device is installed in the ink jet printer so as to measure by the timer the time period from the completion timing of the preceding purging operation even if the main switch of the ink jet printer is turned OFF. However, with this method, the power storage device and associated timer mechanism are required, which is contradictory against recent trend of light weight and compact printer, and which leads to increase in cost.

SUMMARY OF THE INVENTION

It is therefore, an object of the present invention to overcome the above described drawbacks and disadvantages and to provide an improved ink jet type image recording apparatus in which purging operation can be performed at an optimum timing regardless of ON/OFF cycles of the image recording apparatus, to thereby avoid waste of ink.

Another object of the present invention is to provide such apparatus provided at low cost.

Attention is drawn to a general electrical connection between the ink jet type image recording apparatus and a host computer. That is, the ink jet printer is normally connected to the host computer from which data necessary for printing operation is transmitted. Normally, the host computer such as a personal computer installs therein a clock which is driven at all times regardless of ON/OFF of the host computer for performing file management. In other words, the clock mechanism is connected to an uninterruptible power supply. Accordingly, it is possible to measure time elapsing period from the preceding print operation command in printing process control in the host computer by making use of the clock.

In the present invention, purging operation timing is controlled in that the period of non-ejection of ink from the ink head is considered as time elapsing period from the completion timing of preceding or latest purging operation.

Thus, according to the present invention, there is provided an ink jet type image recording apparatus to be used in combination with a host computer for forming an image on an image recording medium, the host computer including a clock means driven by an uninterruptible power supply, and the ink jet type image recording apparatus comprising main power supply means, a print head, a nozzle recovery mechanism, first storage means, second storage means, and control means. The print head has a plurality of nozzles through which ink is ejected for forming the image. The nozzle recovery mechanism is adapted for purging or flushing an interior of the nozzles of the print head. The first storage means is adapted for receiving and storing a time data from the clock means of the host computer. The second storage means is adapted for storing a predetermined period.

The control means is connected to the first storage means, the second storage means, and the nozzle recovery mechanism. The control means has judging means for making judgment as to whether or not the nozzle recovery mechanism should be operated based on the predetermined period and the time data.

In another aspect of the present invention, there is provided an ink jet type image recording apparatus to be used in combination with a host computer for forming an image on an image recording medium, the host computer including a clock means driven by an uninterruptible power supply, and memory means for storing a time counted by the clock means, the memory means also storing therein a printing timing, the ink jet type image recording apparatus comprising a main power supply means, a print head having a plurality of nozzles through which ink is ejected for forming the image, nozzle recovery mechanism for purging or flushing an interior of the nozzles of the print head, a timer for counting a time elapsing period as a first period starting at a turning ON timing of the main power supply means or at a completion timing of a nozzle recovery operation by the nozzle recovery mechanism, means for storing the first period, means for storing a predetermined period, means for receiving and storing a time elapsing period as a second period starting at a preceding printing timing which has been stored in the memory means, and control means connected to the timer, the recovery mechanism, and the storing means for operating the nozzle recovery mechanism prior to printing operation if one of the first and second periods whichever is longer exceeds the predetermined period.

In still another aspect of the present invention, there is provided an ink jet type image recording apparatus to be used in combination with a host computer for forming an image on an image recording medium, the host computer including a clock means driven by an uninterruptible power supply, the ink jet type image recording apparatus comprising a main power supply means, a print head having a plurality of nozzles through which ink is ejected for forming the image, nozzle recovery mechanism for purging or flushing an interior of the nozzles of the print head, means for storing a completion timing of the latest purging or flushing operation by the nozzle recovery mechanism, means for receiving and storing a present time instant as a second time instant from the clock means, means for storing a predetermined period, means for counting a time in response to turning ON timing of the main power supply means, the counting means counting time starting from the completion timing of the latest purging or flushing operation for indicating a first time instant, means for computing a time elapsing period by subtracting the completion timing of the latest purging or flashing operation from the first time instant, and means for controlling an operation timing of the nozzle recovery mechanism, the control means having judging means where judgment is made as to whether or not the time elapsing period is greater than the predetermined period for starting operation of the nozzle recovery mechanism if the judgment falls yes.

In still another aspect of the present invention, there is provided an ink jet type image recording apparatus to be used in combination with a host computer for forming an image on an image recording medium, the host computer including a clock means driven by an uninterruptible power supply, the ink jet type image recording apparatus comprising main power supply means, a print head having a plurality of nozzles through which ink is ejected for forming the image, nozzle recovery mechanism for purging or flushing an interior of the nozzles of the print head, first storage means for storing a completion time instant at which the latest purging operation is completed, second storage means for storing a second time instant provided by the clock means of the host computer, computing means for computing a time elapsing period from the completion time instant to the second time instant, and control means connected to the first storage means, the second storage means, and the nozzle recovery mechanism for operating the nozzle recovery mechanism if the computed time elapsing period is equal to or greater than a predetermined period.

Even if the main power supply means of the ink jet printer is frequently rendered ON and OFF, elapsing period starting from the completion timing of the preceding printing operation to the present time is computed by using the clock connected to the uninterruptible power supply. Therefore, nozzle recovering operation such as purging and flushing can be performed at a proper timing. Accordingly, wasteful ink consumption due to purging operation at improper timing is avoidable, and the unwanted delay of the print start timing can be obviated. Further, it is unnecessary to provide an additional mechanism for preventing unwanted nozzle recovering operation, so that resultant ink jet printer can be provided at a low cost.

DETAILED DESCRIPTION OF THE PREFERRED EMBODIMENTS

Figure 1:
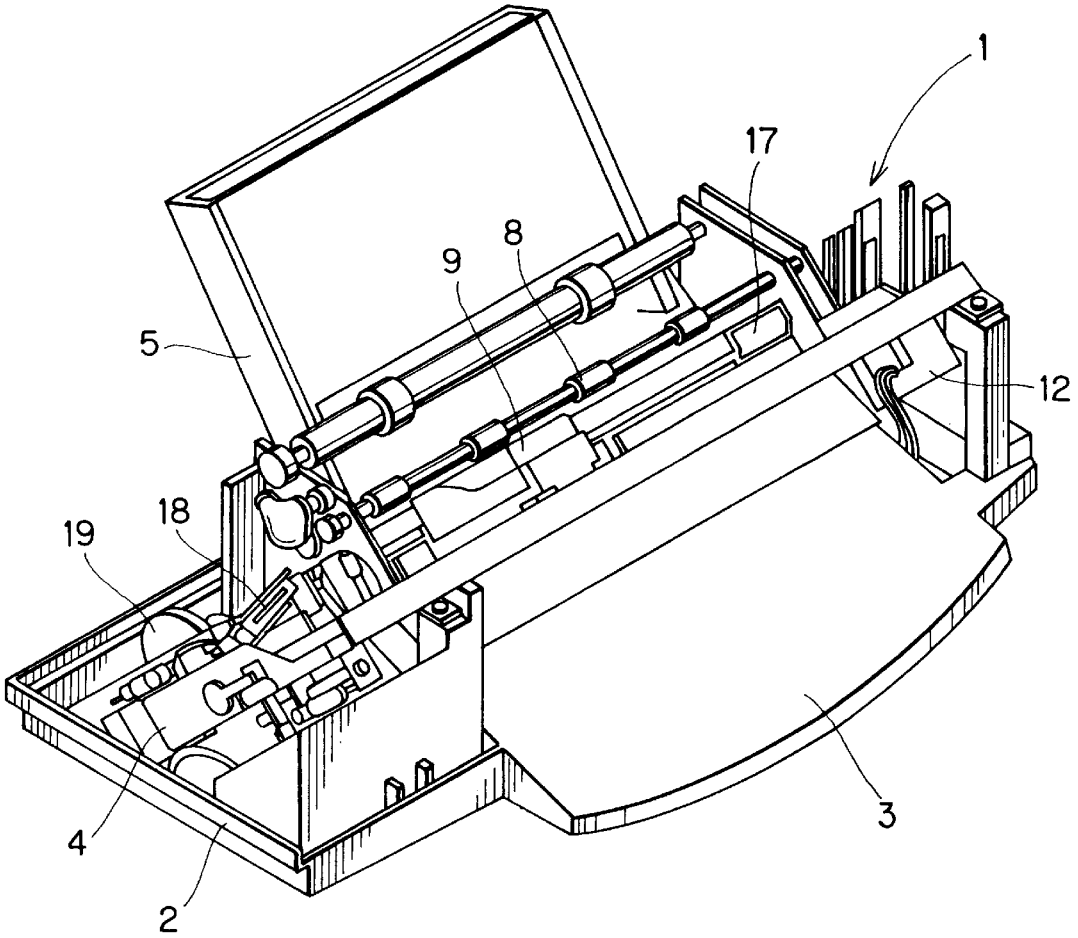
FIG. 1 is a perspective view showing an ink jet printer according to an embodiment of the present invention.
Figure 2:
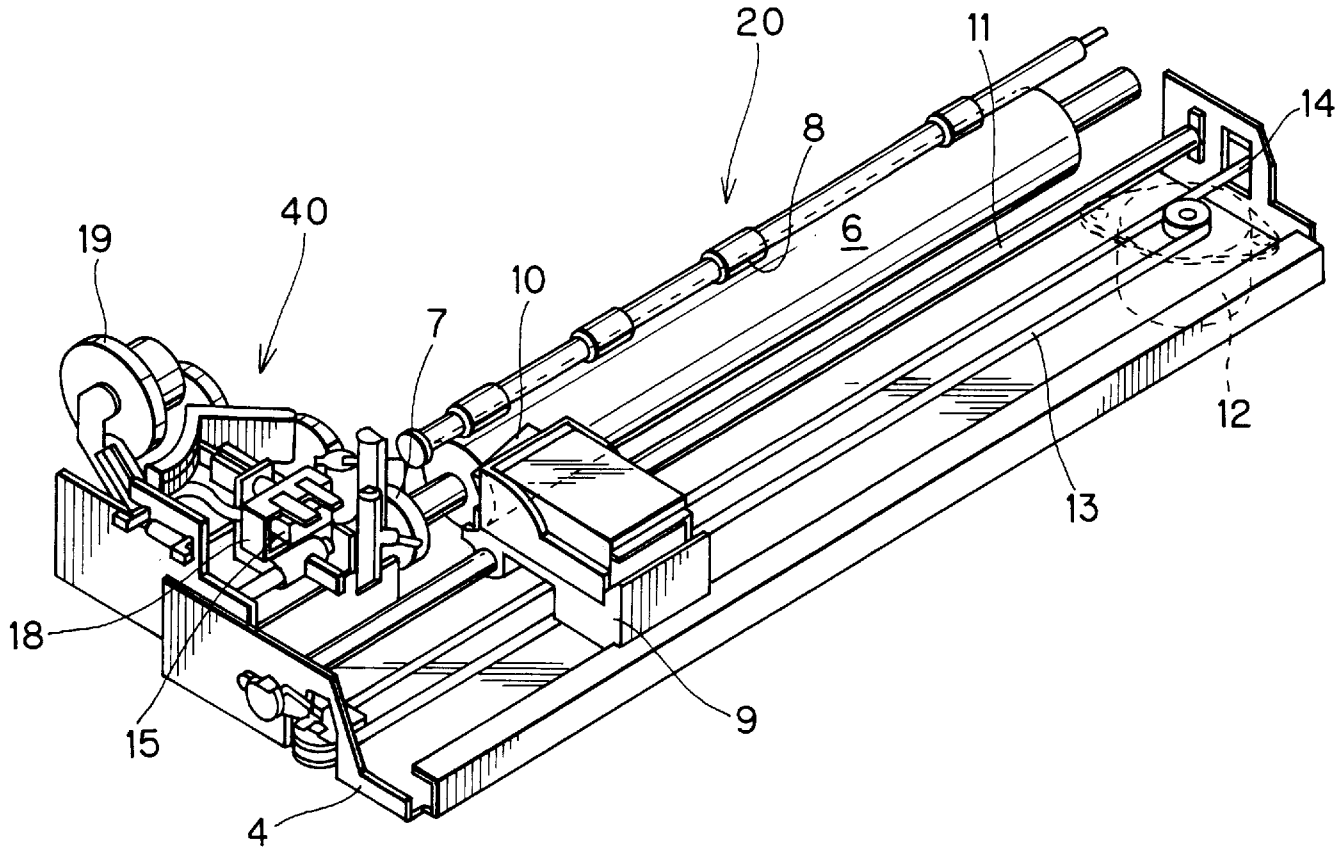
FIG. 2 is a perspective view particularly showing a nozzle recovery mechanism and a sheet feed or line feed mechanism in the printer of FIG. 1.
Figure 3:
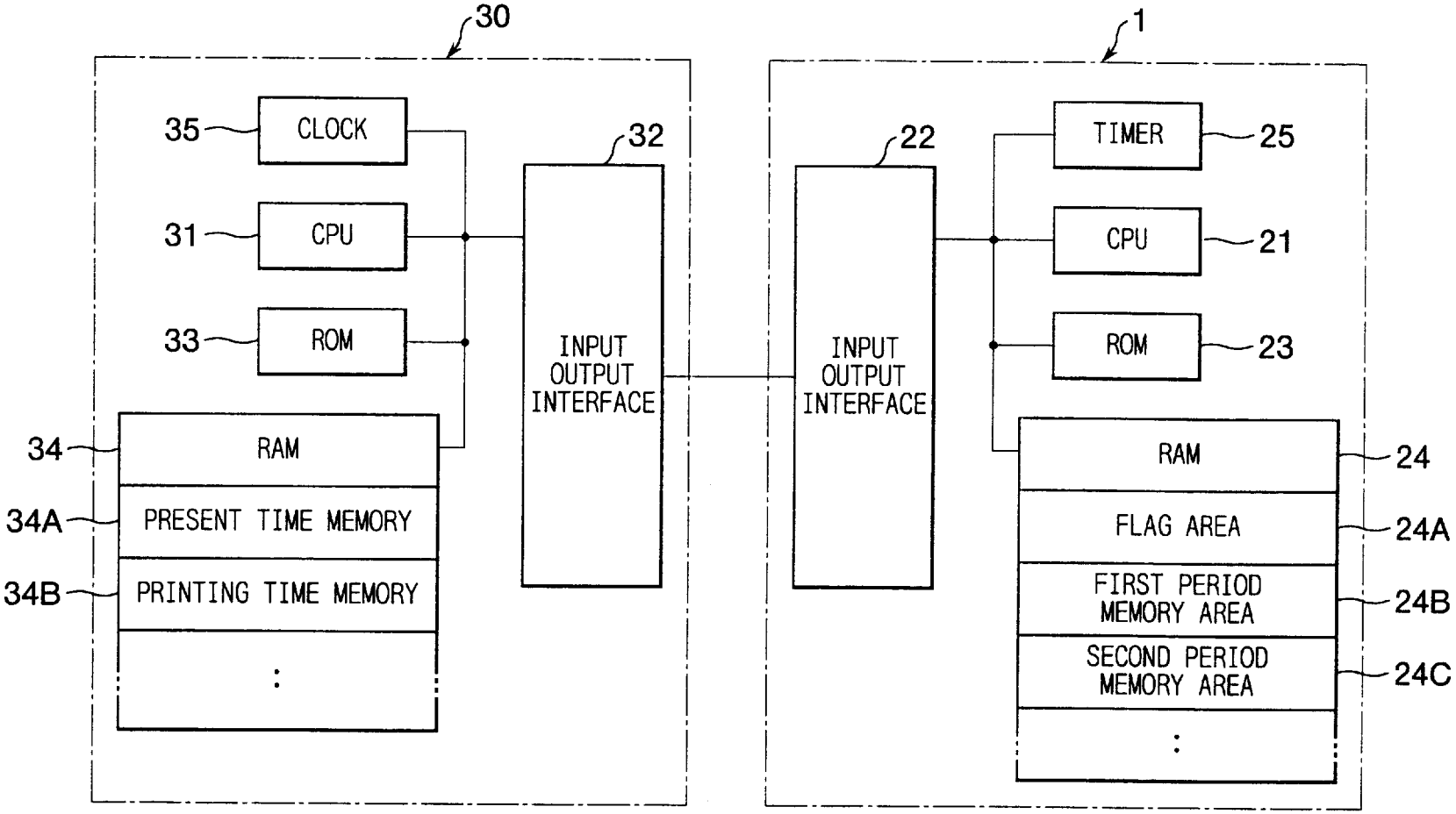
FIG. 3 is a block diagram showing a control system of the ink jet printer of the illustrated embodiment and a host computer connected thereto.

An ink jet type image recording apparatus or printer according to a first embodiment of the present invention will be described with reference to the drawings. A general arrangement of the printer is shown in FIGS. 1 through 3. The ink jet printer 1 includes a main frame 2 having a front portion provided with a manual sheet insertion portion 3 The main frame has an upper portion provided with a sub frame 4 at a position behind the manual sheet insertion portion 3. The sub frame 4 installs therein a print head 10, a line feed mechanism 20 and a nozzle recovery mechanism 40 those described later. A sheet cassette 5 is provided detachably at a position above and behind the sub frame 4 for stacking a plurality of sheets to be printed.

At one side of the main frame 2, an ink absorbing member 17 is provided for absorbing ink which is ejected through the nozzles of the print head 10 for flushing. Flushing is required so as to provide and maintain a desirable ink ejecting condition of the print head 10. For performing flushing, during printing operation, the print head 10 is moved to a position in confrontation with the ink absorbing member 17 and ink is ejected through all the nozzles of the print head to the ink absorbing member 17.

As best shown in FIG. 2, the line feed mechanism 20 includes a platen roller 6 rotatably disposed in the sub frame 4 for feeding the printing sheet in a line feeding direction and in confronting relation to the print head 10, the printing sheet being fed from either the manual sheet insertion portion 3 or the sheet cassette 5. A platen gear 7 is provided for transmitting rotation of a line feed motor (not shown) to the platen roller 6. Further, a pressure roller 8 is provided immediately above the platen roller 6 for urging the printing sheet toward the platen roller 6.

A carriage shaft 11 extends in parallel with an axial direction of the platen roller 6 and at a position in front of the platen roller 6. A carriage 9 mounting thereon the print head 10 of an ink jet type is provided slidably with respect to the carriage shaft 11 so that the carriage 9 is reciprocally movable along the platen roller 6. A carriage return motor 12 is disposed at one lateral side of the sub frame 4 for moving the carriage 9. That is, a drive pulley is coupled to a drive shaft of the carriage return motor 12 and a driven pulley is disposed at the other lateral side of the sub frame 4, and an endless belt 13 to which the carriage is attached is mounted between the drive and driven pulleys. A stepper motor or a DC motor is available as the carriage return motor 12. An encoder 14 or a tape-like position gauge formed with a scale is provided along the endless belt 13 for detecting the reciprocal position of the carriage 9.

At a position other than the printing area of the platen roller 6, the nozzle recovery mechanism 40 is provided for purging the print head 10. For purging operation, a purging device 18 including a cap 15, a pump cam gear 19 and a pump (not shown) are provided. The pump of the purging device 18 is driven by the line feed motor through the pump cam gear 19. More specifically, when the print head 10 is moved outside of the printing region and is covered by the cap 15, the print head 10 is in fluid communication with the pump. Since the pump generates negative pressure, degraded ink and bubbles in the nozzles or an ink droplet deposited on the ejection surface of the print head 10 are suck out by the negative pressure. Thus, desirable ink ejecting condition can be provided by the nozzle recovery mechanism 40 by removing the unwanted materials and bubbles.

A control system of the ink jet printer 1 is shown in a block diagram of FIG. 3. The control system includes a CPU 21 which is connected to a host computer 30 such as a personal computer through input/output interfaces 22 and 32. That is, the ink jet printer 1 performs various printing operation in response to a print command signal transmitted from the host computer 30.

In the control system of the ink jet printer 1, a ROM 23, a RAM 24 and a timer 25, etc. are connected to the CPU 21. The timer 25 is adapted for measuring various time period which is necessary for controlling the ink jet printer 1. The ROM 23 is adapted for storing a purge operation program described later with reference to FIG. 5, and a control routine for printing operation. The RAM 24 is adapted for temporarily storing various numeric values necessary for controlling the ink jet printer 1. For example, the RAM 24 stores a predetermined period which will be compared with a first period described later. The RAM 24 has a flag area 24A, a first period memory area 24B and a second period memory area 24C. The flag 24A is rendered ON as a result of purging or flushing operation after electrical power supply to the ink jet printer. The flag 24A is rendered OFF if no purging or flushing operation is performed after electrical power supply to the ink jet printer. The first period memory area 24B is adapted for storing a first period which is a running or elapsing period starting from the electrical power supply timing to the ink jet printer or from operation finish timing of the nozzle recovery mechanism 40 and ending at the present time. The second period memory area 24C is adapted for storing a second period which is a running or elapsing period starting from the preceding printing operation timing and ending at the present printing operation timing.

Figure 4:
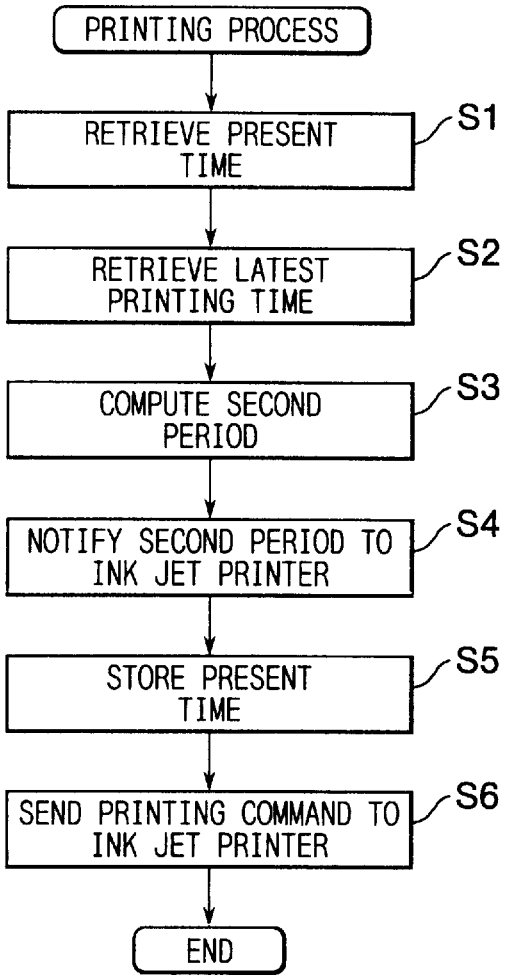
FIG. 4 is a flowchart showing a control routine for printing performed in the host computer.

As shown in FIG. 3, the host computer 30 provides a CPU 31, a ROM 33, a RAM 34, and a clock 35, etc., those connected to the CPU 31. The ROM 33 is adapted for storing a printing process shown in a flowchart of FIG. 4 and other necessary control programs performed in the host computer 30. The RAM 34 is adapted for temporarily storing numeric data necessary for a control in the host computer 30. The RAM 34 has a present time memory area 34A for storing therein the present time and a printing time memory area 34B for storing therein the time at which the latest printing is performed. The clock 35 is adapted for generating a periodical clock signals necessary for control in the host computer 30. The clock 35 is connected to an uninterruptible power supply (not shown), so that time-ticking can be continued regardless of ON/OFF operation of a main power supply.

For printing an inked image on the printing sheet, while the printing sheet is fed by the platen roller 6 from either the manual sheet insertion portion 3 or the sheet cassette 5, the carriage 9 and the print head 10 are controlledly moved in response to the command signal from the host computer 30. For printing characters, marks and figures on the printing sheet, the rotation of the platen roller 6 stops when the sheet is transferred to a desired line printing position. Then, the carriage return motor 12 is actuated for moving the carriage 9 at a predetermined printing speed while the ink is ejected from the print head onto the printing sheet in accordance with image signals.

Next purging process in the ink jet printer 1 will be described with reference to FIG. 5. The purging process is performed in accordance with an instruction issued in a printing process shown in FIG. 4 of the host computer 30. In the printing operation process in the host computer 30, present time is retrieved from the clock 35 and the retrieved present time is stored in the present time memory area 34A in step S1. Then, in step S2, the preceding printing time is retrieved from the printing time memory area 34B. Then, in step S3, is computed "a second period" which is the difference obtained by subtracting the preceding printing time from the present time. Then, the routine proceeds step S4 where the second period is sent to the ink jet printer 1 (step S13 in FIG. 5). Next, in step S5, the present time is retrieved from the clock 35 and the retrieved time is stored in the printing time memory area 34B. This stored data will be used as a preceding printing time in a subsequent printing operation. Then in step S6, printing command signal is transmitted to the ink jet printer 1 for ink ejection, and the program is ended.

Figure 5:
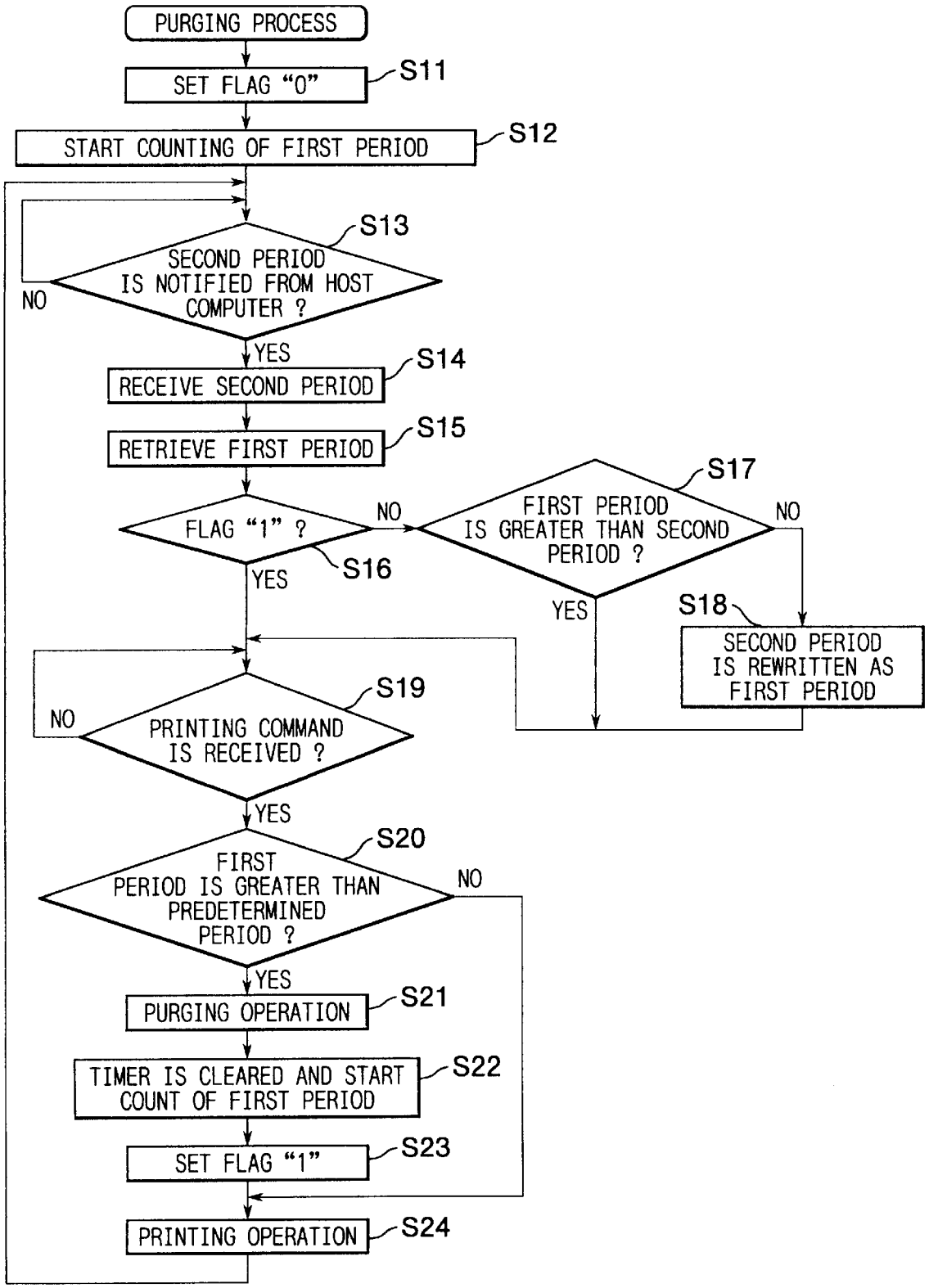
FIG. 5 is a flowchart showing a control routine for purging operation in the ink jet printer according to the first embodiment of this invention.

As shown in FIG. 5, in the purging operation process, when the electric power is supplied to the ink jet printer 1, purging operation process is started in step S11, the flag 24A is set to "0", since actual purging operation nor flushing operation have not yet been performed after the electrical power supply. Then, in step S12, the timer 25 is actuated to start measurement of the first period starting from the electrical power supply timing to the ink jet printer. Then, in step S13, judgment is made as to whether or not data of the second period is transmitted to the ink jet printer. If the data of the second period is transmitted in accordance with the step S4 in FIG. 4 to the CPU 21 of the ink jet printer 1 (S13:Yes), the routine, goes into step S14 where the second period data is stored in the second period memory area 24. On the other hand, if the second period has not yet been transmitted to the ink jet printer 1, the routine returns to S13. Then, in step S15, the first period measured from the timer 25 is retrieved and stored in the first period memory area 24B.

Then, the routine proceeds into step S16 where judgment is made as to whether or not the flag 24A is rendered "1". Since no purging or flushing operation has been performed after electrical power supply to the ink jet printer, the judgment falls No, and the routine goes into step S17. In step S17, judgment is made as to whether or not the first period is longer than the second period. In the first cycle of the flowchart, the judgment falls No, since the preceding printing operation was performed earlier than the electrical power supply timing to the ink jet printer 1. Then, the routine proceeds into step S18, where the second period is stored as a first period in the first period memory area 24B. Then, in step S19, judgment is made as to whether or not the print operation command signal is transmitted from the host computer 30. If the judgment falls No, the routine goes back to the step S19. If the print operation command signal is transmitted from the host computer 30, the routine goes into step S20.

Upon receipt of the print operation command signal from the host computer 30 in step S19, the first period stored in the first period memory area 24B is compared with the predetermined period in step S20. The predetermined period is experimentally obtained and provisionally stored in the RAM 24. If the first period is longer than the predetermined period, the judgment in step S20 falls Yes, ("Yes" implies that long interval has been continuing from the preceding printing operation to the present time, so that some disadvantageous phenomena may have been occurring such as ink solidification in the nozzles, etc.). Thus, in Step S21, purging is performed.

After purging, in step S 21, the timer 25 is reset, so that a measurement of a next first period is started. The start timing for the first period is not the power supply timing but the purging completion timing. Then, in step S23, the flag 24A is rendered "1", since the purging was performed in step S21 after electrical power supply to the ink jet printer 1. Next, the routine goes into step S24 for performing actual printing operation, and then the routine returns back to the step S13. In the next cycle S13 through S24, the judgment in step S16 falls "Yes" so that the routine proceeds into step S19 without the steps of S17 and S18.

On the other hand, it the first time through the routine in the step S20, if the first period is shorter than the predetermined period (S20: No), the routine goes to the step S24 without the steps S21 through S23 because purging is unnecessary. In this case, since the step S23 is not performed, the flag 24A is still rendered "0". In this case, after the routine goes back to the step S13 for the second printing operation, the judgment in step S16 falls No, and the routine goes into the step S17. In the step S17, the first period is compared with the second period. In this case, the first period in the second flow cycle was the second period in the first flow cycle (see step S18 in the first cycle). Therefore, the judgment falls Yes, and the routine goes into the step S19, that is, data rewriting step (S18) is not performed in the second flow cycle.

Thus, in the ink jet printer according to the first embodiment, the second period which starts at the print completion timing of the preceding printing operation can be computed (steps S2 and S3) based on the clock 35 of the host computer 30 (step S1). Further, if the first period measured by the timer 25 is shorter than the second period, that is, if the purging operation or flushing operation has not yet been performed after electric power supply to the ink jet printer, the first period is replaced by the second period (S18) and the replaced second period (now rewritten as the first period) is compared with the predetermined period (S20). Accordingly, even if the timer 25 of the ink jet printer cannot measure the period starting from the preceding purging or flushing operation due to the frequent shut off of the electrical power supply to the ink jet printer 1, the second period starting from the print completion timing of the preceding printing operation (the period during which the ink head 10 has not been ejecting ink) can be used as the first period (S18) for conducting purging or flushing operation at a proper timing (S20, S21).

An ink jet printer according to the second embodiment of the invention will next be described. The second embodiment provides a mechanical arrangement identical with that of the first embodiment. However, purging operation process of the second embodiment is different from that of the first embodiment. More specifically, in the second embodiment, the steps S15 through S17 are not performed. Instead, after the step S14, the routine goes directly to the step S18. Accordingly, in the second embodiment, the second period is always rewritten to the first period in step S18 regardless of the binary value of the flag 24A, so that the period is compared with the predetermined period in step S20. In other words, in the second embodiment, the timer 25 of the ink jet printer 1 is not used, but the purging operation is controlled on the basis of only the clock 35 of the host computer 30.

Thus, the ink jet printer according to the second embodiment also, purging operation can be controlledly performed after elapse of a predetermined period from the preceding printing operation regardless of ON/OFF frequency of the ink jet printer 1.

An ink jet printer according to a third embodiment of the present invention will next be described. In the first embodiment, the data of the second period is produced in the host computer 30, and the data of the second period is transmitted to the printer 1. However, in the third embodiment, a host computer 130 only transmits an actual present time instant to a printer 101.

Figure 6:
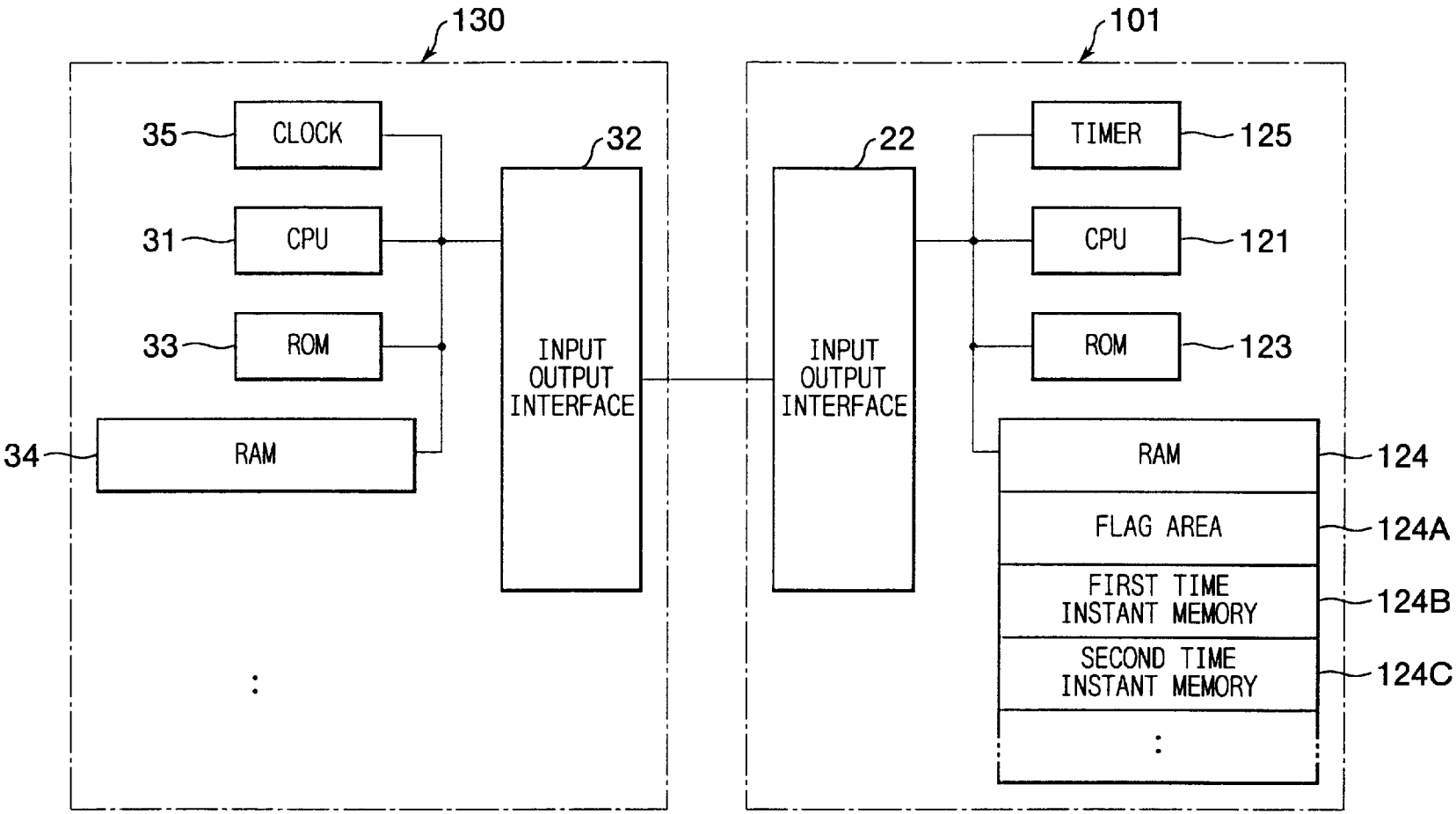
FIG. 6 is a block diagram showing a control system of the ink jet printer according to a third embodiment of the present invention.

More specifically, in the third embodiment, as shown in FIG. 6, the host computer 130 is not provided with the present time memory area 34A nor the printing time memory area 34B in the first embodiment. Further, the printer 101 has timer 125, a CPU 121, a ROM 123 and a RAM 124. The RAM 124 has a flag area 124A similar to the flag area 24A of the first embodiment, a first time instant memory area 124B, and a second time instant memory area 124C. The first time instant memory area 124B is provided by NVRAM and is adapted to store therein the preceding or latest purging or flushing timing. The second time instant memory area 124C is adapted to store the present time instant (second time) sent from the clock 35 of the host computer 1. The timer 125 is adapted for indicating a time instant (first time) counting from the preceding purging or flushing timing, the counting being started in response to the electrical power supply to the printer 101.

Figure 7:
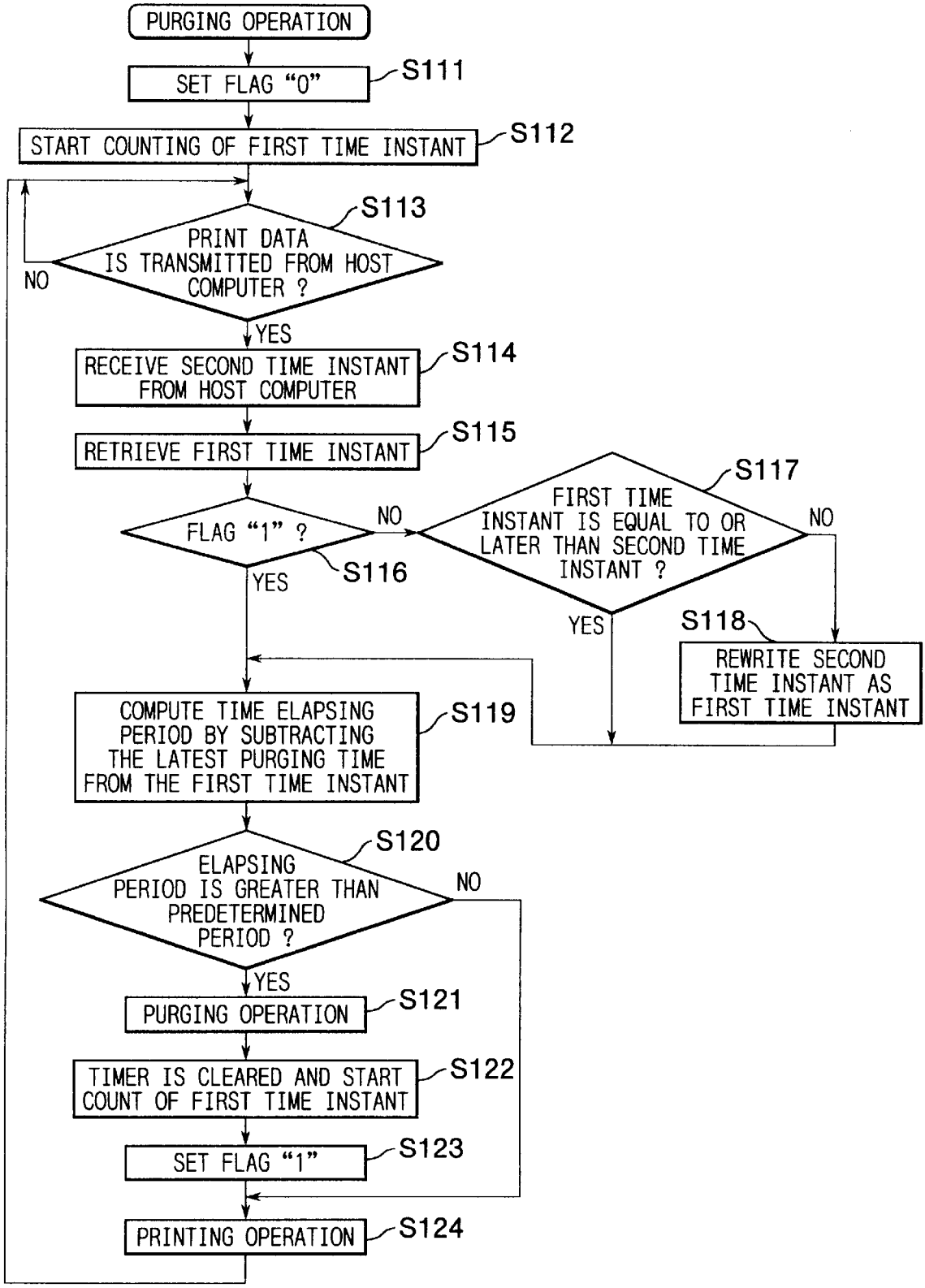
FIG. 7 is a flowchart showing a control routine for purging operation in the ink jet printer according to the third embodiment of the present invention.

More specifically, as shown in a flowchart shown in FIG. 7, in step S111, the flag 124A is set to "0", since actual purging operation nor flushing operation have not yet been performed after the electrical power supply. Then, in step S112, the timer 125 is actuated to start measurement of the first time instant starting from the preceding purging timing stored in the first time instant memory 124B of the printer 101. For example, assuming that the preceding purging operation was performed on Jan. 1, 1996, and the electrical power was shut off on Jan. 5, 1996. Then the electrical power supply to the printer was made on Jan. 8, 1996. In such a case, in step S112, the first time instant is counted from the date of Jan. 1, 1996 (which date is the date of preceding purging).

Then, in step S113, judgment is made as to whether or not the printing data is transmitted from the host computer 130. If the print data is transmitted, the routine proceeds into step S114. On the other hand, if the print data has not yet been transmitted from the host computer 130 to the printer 101, the step 113 is repeated.

In step S114, the data of actual or present time instant (second time) is transmitted from the host computer 130 to the second time instant memory area 124C. This data is not the "second period" in the first embodiment, but the actual or present time instant indicated by the clock 35 of the host computer 130. In the present example, the second time instant is Jan. 8, 1996.

Then, in step S115, the first time instant measured by the timer 125 is retrieved and stored in the first time instant memory area 124B. Then, the routine proceeds into step S116 where judgment is made as to whether or not the flag 124A is rendered "1". Since no purging or flushing operation has been performed after electrical power supply to the ink jet printer 101 (after Jan. 8, 1996), the judgment falls No, and the routine goes into step S117. In step S117, judgment is made as to whether or not the first time instant is equal to or later than the second time instant. In the first cycle of the flowchart, the judgment falls No, since the preceding printing operation was performed earlier than the electrical power supply timing to the ink jet printer 1. That is, assuming that now is the Jan. 11, 1996 (three days have been passed from the electrical power supply timing, Jan. 8, 1996), the second time instant is Jan. 11, 1996. On the other hand, the first time instant is Jan. 4, 1996 (three days after the Jan. 1, 1996). Therefore, herein the first time instant is earlier than the second time instant.

Then, the routine proceeds into step S118, where the second time instant is rewritten as the first time instant and stored in the first time instant memory area 124B. Then, in step S119, computation is executed so as to obtain a time elapsing period from the preceding purging timing to the first time instant. (for example, from Jan. 1, 1996 to Jan. 11, 1996=10 days).

Then in step S120, the time elapsing period is compared with a predetermined period (for example 10 days). Incidentally, the predetermined period is experimentally obtained and provisionally stored in the RAM 124. If the elapsing period is equal to or greater than the predetermined period (S120:Yes) the judgment in step S120 falls Yes, and the routine goes into step S121 where purging is performed.

After purging, in step S122, the timer 125 is reset, so that a measurement of a "next" first time instant is started. The start timing for the first time instant is not the power supply timing but the purging completion timing. Then, in step S123, the flag 124A is rendered "1", since the purging was performed in step S121 after electrical power supply to the ink jet printer 101. Next, the routine goes into step S124 for performing actual printing operation, and then the routine returns back to the step S113.

In the next cycle, S113 through S124, the judgment in step S116 falls "Yes" so that the routine proceeds into step S119 without the steps of S117 and S118. In the second cycle, in the step S120, if the time elapsing period is shorter than the predetermined period, (S120: No), for example, assuming that now is the Jan. 12, 1996, the elapsing period is one day (from Jan. 11, 1996 which is the latest purging timing to the present date of Jan. 12, 1996) whereas the predetermined period is 10 days, the routine goes to the step S124 without the steps S121 through S123 because purging is unnecessary.

Incidentally, in step S117, normally, the first time instant is earlier than the second time instant after the electrical power supply to the printer and no purging operation has been performed after the electrical power supply. However, there may be the case that the second time instant is earlier than the first time instant. For example, after the completion timing of purging is stored in the first time instant memory area 124B, and the printer 101 is rendered OFF, and a user may turn back the clock in the host computer 101 to obtain a correct calendar data, and then the printer is turned ON. In such a case, in the subsequent step of S117, the first time instant may be later than the second time instant. If this is the case, the rewriting step in S118 is not performed, In this way, according to the third embodiment of this invention, the host computer 130 only transmits the data of the actual present time instant to the printer 101, whereas the printer 101 has a computation program so as to compute the time elapsing period starting from the precedent or latest purging timing. Therefore, purging can be performed at a proper timing as far as the clock 35 in the host computer indicates a correct time instant.

Figure 8:
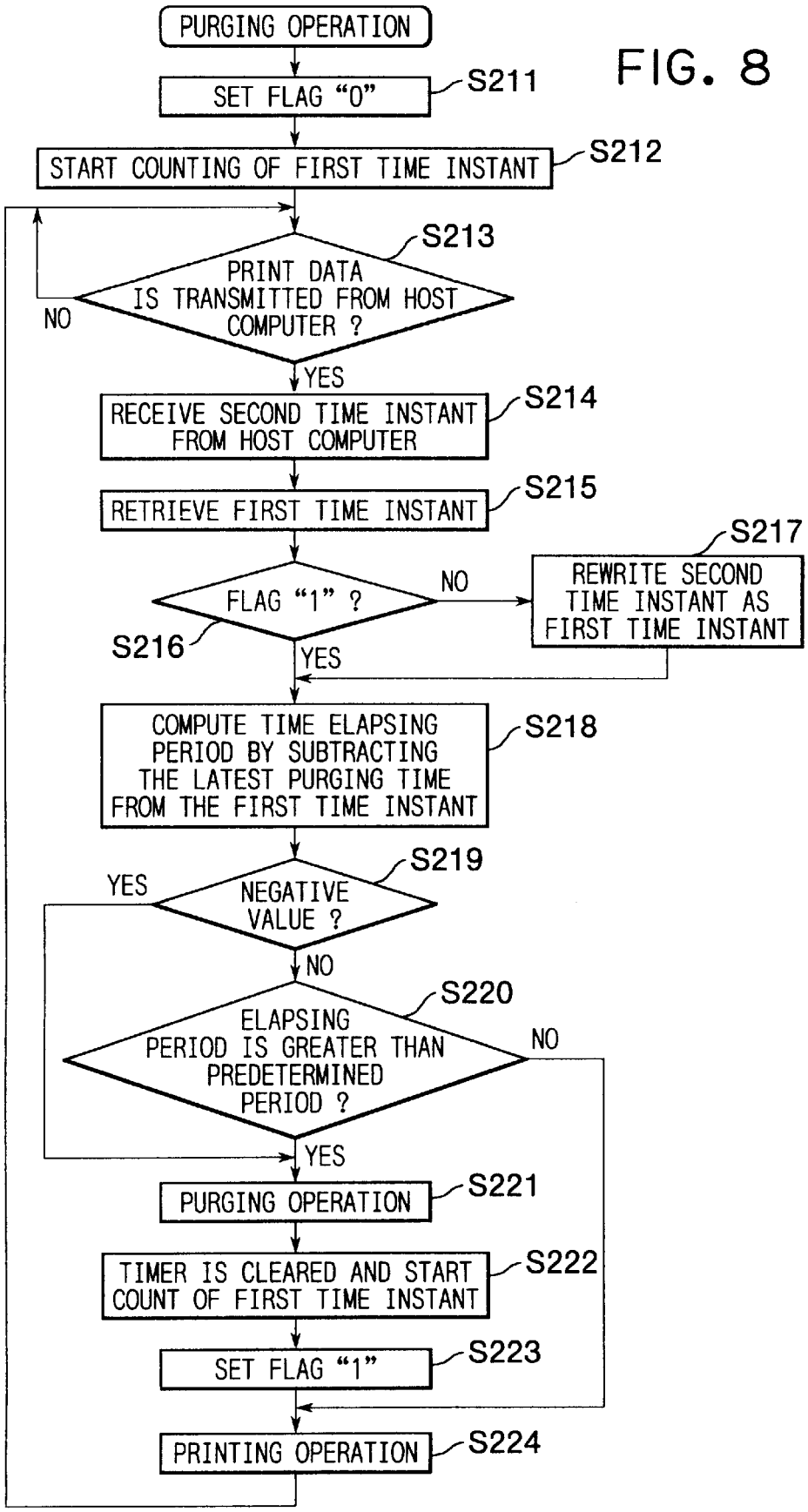
FIG. 8 is a flowchart showing a control routine for purging operation in the ink jet printer according to a fourth embodiment of the present invention.

An ink jet type image recording apparatus according to a fourth embodiment of the present invention will be described with reference to FIG. 8. The fourth embodiment concerns an improvement on the third embodiment. More specifically, in the third embodiment, assuming that the recovery operation of the printer 101 is performed while the time of the clock 35 of the host computer 130 is inaccurate, the first time instant memory 124B stores the inaccurate time instant. For example, provided that the accurate present time instant is Feb. 1, 1996 whereas the time of the clock 35 of the host computer 130 shows Feb. 1, 1997, if the recovery operation is performed on Feb. 1, 1996, the first time instant memory 124B stores the first time instant data of Feb. 1, 1997 as a recovery timing instant.

Thereafter, provided that the user acknowledges the inaccurate time of the clock 35 and modifies the time of the clock 35 into a correct time instant, and then, the power switch of the printer is rendered OFF. Then, when the main power switch of the printer is rendered ON 10 days after the latest recovery operation, the timer 125 of the printer 101 starts time counting operation from Feb. 1, 1997. If the print data is transmitted from the host computer (S113: Yes) 5 days after the power ON timing, i.e., 15 days after the latest recovery operation, the second time instant (Feb. 16, 1996) is notified from the host computer 130 to the second time instant memory 124C.

Then, the first time instant (Feb. 6, 1997) timed by the timer 125 is retrieved, and the determination in step S116 falls NO, and the routine goes into the step S117. In step S117, the determination falls Yes, since the first time instant (Feb. 6, 1997) is later than the corrected present time instant of Feb. 15, 1996. In step S119, the computation falls 5 days (Feb. 6, 1997 minus Feb. 1, 1997). Even though the actual time elapsing period is 15 days, (from Feb. 16, 1996 to Feb. 1, 1996), the computed time elapsing period is 5 days, so that printing operation is started without performing recovery operation. Accordingly, degraded printing results. Such unwanted state may be continued for almost one year.

The fourth embodiment can solve such disadvantage. In the flowchart shown in FIG. 8, the process starting from steps S211 to S216 are the same as the steps S111 to S116 (FIG. 7) of the third embodiment. In step S216, if the determination falls NO, i.e, the present printing operation is the first printing operation after electric power supply to the printer 101, the routine goes into step S217 where the second time instant is rewritten as the first time instant, and is stored in the first time instant memory 124B.

Then, the routine goes into step S218 where is computed the time elapsing period by subtracting the latest purging time from the first time instant similar to the step S119. Then, in step S219, judgment is made as to whether or not the computed elapsing period is a "negative" value. For example, in the above described example, if the latest purging time was erroneously stored as Feb. 1, 1997, the computation falls negative value. If the judgment falls NO, the routine goes into step S220 similar to the step S120 of the third embodiment, and the steps S221 through S224 are executed those being the same as the steps S120 to S124 of the third embodiment. On the other hand, if the judgment in S219 falls Yes, the routine goes into the step S221, so that purging can be performed.

Therefore, in the fourth embodiment, even if the time of the clock 35 of the host computer 130 is initially inaccurate, the purging operation can surely be performed as long as the judgment in step S219 falls Yes. Accordingly, the above described problem inherent to the third embodiment can be overcome.

An ink jet type image recording apparatus according to a fifth embodiment of the present invention will be described with reference to FIG. 9. The fifth embodiment concerns an alternative improvement on the third embodiment in order to overcome the above described drawbacks in the third embodiment.

Figure 9:
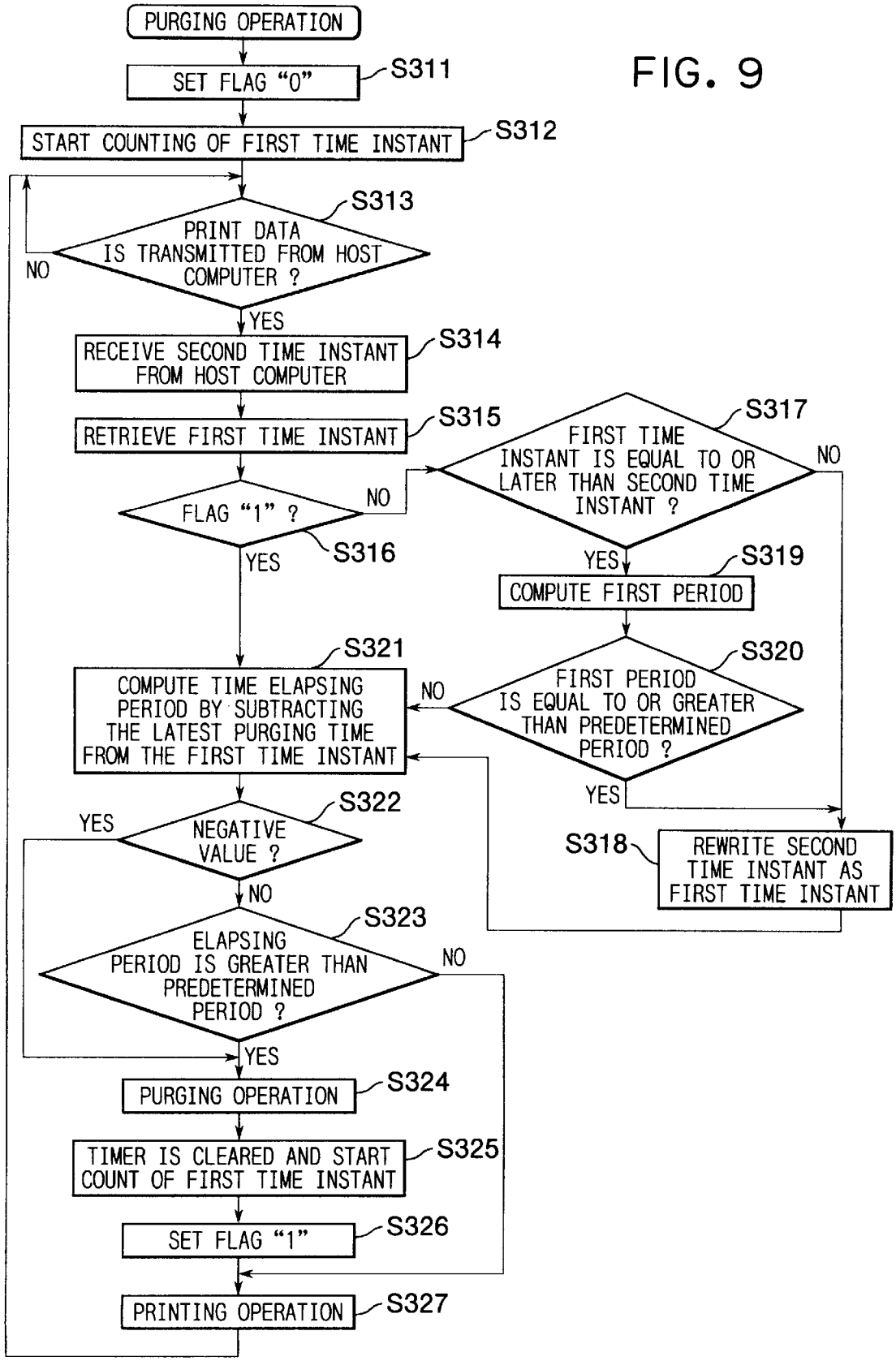
FIG. 9 is a flowchart showing a control routine for purging operation in the ink jet printer according to a fifth embodiment of the present invention.

In FIG. 9, steps S311 through S317 are the same as the steps S111 through S117 of the third embodiment. In step S317, if the first time instant is equal to or later than the second time instant (S317:Yes), the routine goes into step S319 where a first period is computed. The first period is the time period by subtracting the second time instant from the first time instant. Then, in step S320, judgment is made as to whether or not the first period is equal to or greater than the predetermined period. Here, the predetermined period is identical with the predetermined period in step S120 or S220. If the judgment falls Yes, the routine proceeds into steps S318, S321, S322 those being the same as the steps S217, S218 and S219 of the fourth embodiment. On the other hand, if the judgment in the step S320 falls No, the routine proceeds into the step S321. The subsequent steps S322 through S327 are the same as the steps S 219 through S224 of the fourth embodiment. In the fifth embodiment, by way of the steps S317 through S324, the above-described problem in the third embodiment can be solved.

Figure 10:
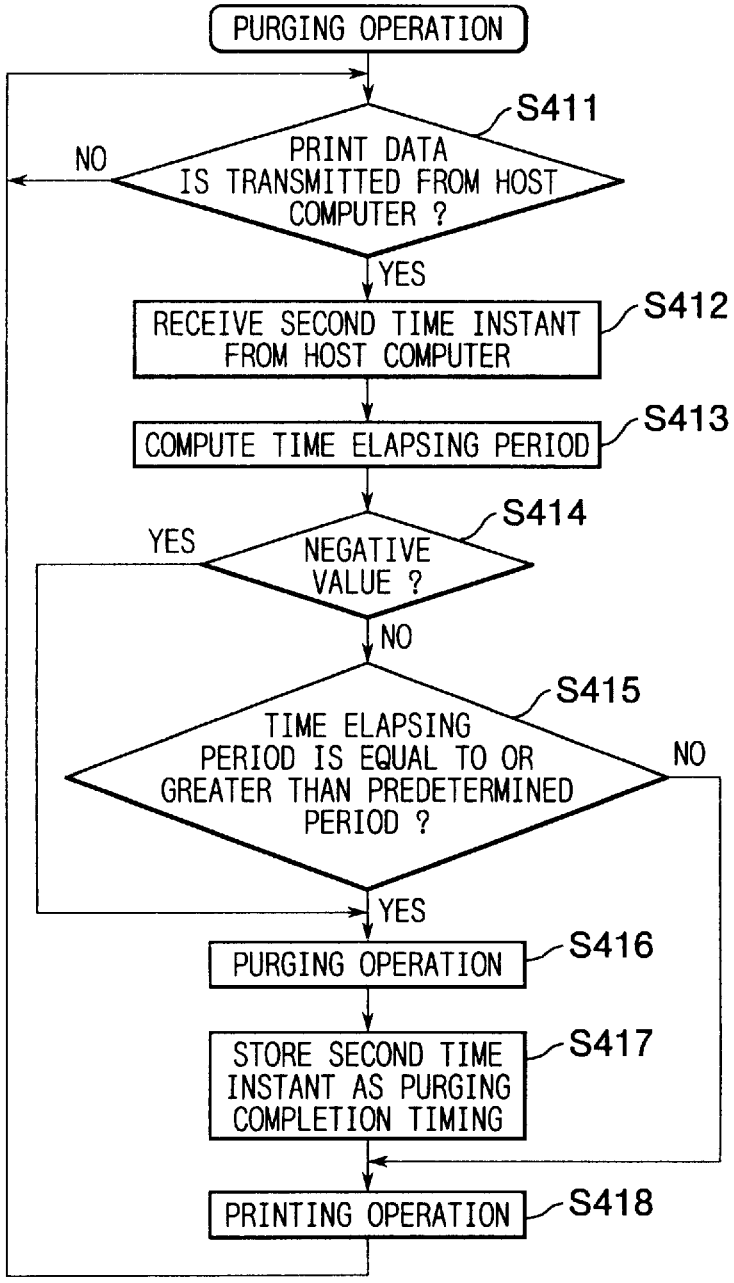
FIG. 10 is a flowchart showing a control routine for purging operation in the ink jet printer according to a sixth embodiment of the present invention.

An ink jet type image recording apparatus according to a sixth embodiment of the present invention will be described with reference to FIG. 10. The sixth embodiment is similar to the third embodiment except that the timer 125 and the flag area 124A in the third embodiment are not provided in the sixth embodiment.

The purging operation control process in the sixth embodiment will be described. When the electrical power is supplied to the ink jet printer, the purging operation control process will be started. First, in step S411, judgment is made as to whether or not the print data is transmitted from the host computer 130. If the print data has not yet been transmitted (S411:No), the routine returns back to the step S411. If the print data is transmitted (S411: Yes), the routine goes into step S412 where the present time instant is notified, as a second time instant, from the host computer 130 to the second time instant memory area 124C of the ink jet printer. This time data is the present time transmitted from the clock 35 of the host computer 130. For example, the present time instant is January 11.

Then, in step S413, a time elapsing period is computed by subtracting the latest purging time instant (for example, January 1) from the second time instant. That is, January 11–January 1=10 days. Then, in step S414, judgment is made as to whether or not the time elapsing period is negative value. If the judgment falls Yes, the routine jumps to step S416, so that purging operation is performed. On the other hand, the computed time elapsing period is not a negative value, the routine proceeds into step S415. In the step S415, the time elapsing period is compared with the predetermined period which has been stored in the RAM 124. If the time elapsing period is equal to or greater than the predetermined period (S415:Yes), the routine goes into the step S416, so that purging operation is performed. On the other hand, if the judgment in step S415 falls No, the routine proceeds into step S418 in order to perform printing operation.

After the step S416, i.e., after completion of the purging operation, the second time instant is rewritten as the purging time instant (i.e., as the first time instant) in the first time instant memory area 124B in step S417. Then, in the step S418, printing operation is performed, and the routine returns back to S411.

Incidentally, if the time instant of the clock 35 of the host computer 130 is accurate, the judgment in the step S414 falls No, i.e., the computed time elapsing period is a positive value. However, there may be the case in which the time elapsing period is a negative value, i.e., the second time instant is earlier than the purging completion timing. This may happen in the following manner. First, the purging completion timing is stored in the first time instant memory area 124B with an incorrect time set in the clock 35 of the host computer, and then, main switch of the printer is turned OFF. Then, the operator corrects the time of the clock 35 and then, the main power switch of the printer is turned ON. In such a case, in the step S414, negative value is obtained, and the step S415 is not executed.

In the ink jet printer of the illustrated embodiment, time period from the purging completion timing can be computed with the clock 35 of the host computer 130. Accordingly, purging operation can be performed after elapse of the predetermined period in spite of the frequent ON OFF operation of the printer. Consequently, ink waste can be minimized, and unwanted delay of the print start timing is avoidable, and it is possible to dispense with the additional device for preventing unwanted purging operation.

In the sixth embodiment, if the time elapsing period becomes a negative value, purging operation is surely performed. Therefore, even if the latest purging completion timing is erroneously stored in the first time instant memory area 124B due to incorrect time of the clock 35, the print head can surely be recovered by timely purging operation. Further, when the print command is notified, the time elapsing period is computed. Therefore, the print head is easily subjected to ink ejection state at the print start timing, so that desirable printing results.

While the invention has been described in detail and with reference to the specific embodiments thereof, it would be apparent to those skilled in the art that various changes and modifications may be made therein without departing from the spirit and scope of the invention. For example, a flushing button is provided in an operation key of the printer so as to perform flushing operation instead of the above described purging operation. If the flushing button is pressed, the flushing is performed and the timer 25 is reset in the step S22 and the flag 24A is rendered "1" in step S23.

Further, it is possible to govern the purging operation by the host computer 30. In this case, the host computer controls the ink jet printer 1 such that the ink jet printer 1 performs purging operation in response to the purging operation command signal from the host computer 30 in the step of, for example, step S21 in FIG. 5. In this case, the host computer must perform judgment as to whether or not the ink jet printer actually performs purging operation. To this effect, the ink jet printer should transmit a signal indicative of accomplishment of the purging. Alternatively, the ink jet printer is adapted to refuse reception of any signal from the host computer during purging operation of the ink jet printer, and the refusal period is detected by the host computer to conclude that the purging operation is actually carried out in the ink jet printer.

Further, in the illustrated embodiment, purging operation is performed if the time elapsing period is equal to or greater than the predetermined period. However, it is possible to provide a plurality of predetermined periods, i.e., a first predetermined period and a second predetermined period greater than the first predetermined period. In this case, a flushing operation can be performed if the time elapsing period is equal to or greater than the first predetermined period and is less than the second predetermined period, whereas the purging operation can be performed if the time elapsing period is equal to or greater than the second predetermined period. Furthermore, it is possible to provide three or more predetermined periods so that the flushing and purging frequency can be changed. In this way, optimum recovery operation can be performed by changing recovery operation mode in accordance with the time elapsing period, thereby avoiding ink waste.

Further, in the sixth embodiment, the time elapsing period is computed when the print data is transmitted from the host computer. However, it is possible to compute the period when the main power switch of the printer is rendered ON.

What is claimed is:

1. An ink jet type image recording apparatus to be used in combination with a host computer for forming an image on an image recording medium, the host computer including a clock means driven by an uninterruptible power supply, the ink jet type image recording apparatus comprising:

main power supply means;

a print head having a plurality of nozzles through which ink is ejected for forming the image;

nozzle recovery mechanism for purging or flushing an interior of the nozzles of the print head;

first storage means for receiving and storing a time data from the clock means of the host computer;

second storage means for storing a predetermined period; and, control means connected to the first storage means, the second storage means, and the nozzle recovery mechanism, the control means having judging means for making judgment as to whether or not the nozzle recovery mechanism should be operated based on the predetermined period and the time data.

2. The ink jet type image recording apparatus as claimed in claim 1, further comprising a timer for counting a time as a first time data starting at a turning ON timing of the main power supply means or at a completion timing of a nozzle recovery operation by the nozzle recovery mechanism, and wherein the time data from the clock means is a second time data, and wherein the control means is further connected to the timer, so that the judging means makes judgment based on the predetermined period, the first time data and the second time data.

3. The ink jet type image recording apparatus as claimed in claim 2, wherein the host computer has memory means for storing a second time period counted by the clock means, the memory means also storing therein a printing timing, and wherein the first time data is a first time period starting at a turning ON timing of the main power supply means or at a completion timing of a nozzle recovery operation by the nozzle recovery mechanism, and wherein the second time data is the second time period starting at a preceding printing timing which has been stored in the memory means.

4. The ink jet type image recording apparatus as claimed in claim 3, further comprising:

flag means rendered ON if the nozzle recovery mechanism is operated after turning ON the main power supply means, and rendered OFF if the nozzle recovery mechanism is not operated after turning ON the main power supply means; and, the control means being also connected to the flag means for operating the nozzle recovery mechanism prior to printing operation if one of the first and second periods whichever is longer exceeds the predetermined period if the flag means is rendered OFF, and for operating the nozzle recovery mechanism prior to printing operation if the first period exceeds the predetermined period if the flag means is rendered ON.

5. The ink jet type image recording apparatus as claimed in claim 2, further comprising selection means for selecting one of the first and second periods whichever is longer in order to compare the selected one of the period with the predetermined period.

6. The ink jet type image recording apparatus as claimed in claim 5, wherein the selection means comprises means for judging as to whether the first period is longer than the second period, and means for rewriting the second period into the first period if the second period is longer than the first period in the judgment by the judging means, the control means operating the nozzle recovery mechanism prior to printing operation if the rewritten period exceeds the predetermined period if the flag means is rendered OFF.

7. The ink jet type image recording apparatus as claimed in claim 5, further comprising reset means for resetting the timer after purging operation, so that the timer starts counting time from the completion timing of the nozzle recovery operation by the nozzle recovery mechanism.

8. The ink jet type image recording apparatus as claimed in claim 2, wherein the first time data is a first time instant counting from the latest completion timing of nozzle recovery operation by the nozzle recovery mechanism in response to turning ON timing of the main power supply means, and wherein the second time data is a second time instant which indicates an actual present time instant provided by the clock means of the host computer to the first storage means.

9. The ink jet type image recording apparatus as claimed in claim 8, wherein the control means has means for computing a time elapsing period obtained by subtracting a completion timing of a precedent nozzle recovery operation from the first time instant, the judging means making judgment as to whether or not the time elapsing period is greater than the predetermined period for operating the nozzle recovery mechanism if the time elapsing period is greater than the predetermined period.

10. The ink jet type image recording apparatus as claimed in claim 9 further comprising flag means rendered ON if the nozzle recovery mechanism is operated after turning ON the main power supply means, and rendered OFF if the nozzle recovery mechanism is not operated after turning ON the main power supply means.

11. The ink jet type image recording apparatus as claimed in claim 9 further comprising means for rewriting the second time instant into the first time instant if the first time instant is earlier than the second time instant if the flag means is rendered OFF.

12. The ink jet type image recording apparatus as claimed in claim 8, further comprising:

further storage means for storing a completion time instant of the latest nozzle recovery operation;

selection means for selecting one of the first and second time instant;

computing means for computing a time elapsing period from the completion time instant of the latest nozzle recovery operation to the selected one of the first and second time instant selected by the selection means;

the control means transmitting a signal indicative of driving the nozzle recovery mechanism if the computed time elapsing period is equal to or greater than the predetermined period.

13. The ink jet type image recording apparatus as claimed in claim 12, wherein the selection means selects one of the first and second time instant when the printing operation is started, the control means transmitting the driving signal for operating the nozzle recovery mechanism prior to the print start timing if the computed time elapsing period is equal to or greater than the predetermined time period.

14. The ink jet type image recording apparatus as claimed in claim 13, wherein the selection means comprises judging means for judging whether or not the nozzle recovery mechanism has been operated after turning ON the main power supply means, the selection means selecting the first time instant if the judgment in the judging means of the selection means falls yes.

15. The ink jet type image recording apparatus as claimed in claim 14, wherein the selection means further comprises comparison means for comparing the first time instant with the second time instant so as to determine which one is later, the selection means selecting one of the first and second time instant based on the comparison in the comparison means if the judging means makes judgment that the nozzle recovery mechanism has not yet been operated.

16. The ink jet type image recording apparatus as claimed in claim 15, wherein the selection means further comprises:

computing means for computing a first period obtained by subtracting the second time instant from the first time instant if the comparison means judges that the first time instant is later than the second time instant; and second comparison means for judging whether or not the first period is equal to or greater than the predetermined period, the selection means selecting one of the first and second time instant based on the comparison in the second comparison means.

17. The ink jet type image recording apparatus as claimed in claim 14, wherein the selection means selects the second time instant if the judging means makes judgment that the nozzle recovery operation has not yet been performed after turning ON the main power supply means; and the control means further comprising nozzle recovery operation execution means for operating the nozzle recovery mechanism if the time elapsing period computed in the computing means is a negative value.

18. The ink jet type image recording apparatus as claimed in claim 12, wherein the predetermined period comprises a first predetermined period and a second predetermined period greater than the first predetermined period, the control means controlling the nozzle recovery mechanism to be operated in a first mode if the computed time elapsing period is equal to or greater than the first predetermined period but is less than the second predetermined period and in a second mode if the computed time elapsing period is equal to or greater than the second predetermined period.

19. The ink jet type image recording apparatus as claimed in claim 1, further comprising:

further storage means for storing a completion time instant of the latest nozzle recovery operation, the second time data being a second time instant which indicates an actual present time instant provided by the clock means of the host computer to the first storage means;

computing means for computing a time elapsing period from the completion time instant of the latest nozzle recovery operation to the second time instant; and the control means transmitting a signal indicative of driving the nozzle recovery mechanism if the computed time elapsing period is equal to or greater than the predetermined period.

20. The ink jet type image recording apparatus as claimed in claim 19, wherein the judging means of the control means comprises:

judgment means for making judgment as to whether or not the computed time elapsing period computed in the computing means is a negative value; and recovery operation execution means for operating the recovery mechanism if the computed value is the negative value.

21. The ink jet type image recording apparatus as claimed in claim 20, wherein the first storage means stores the second time instant when printing operation is started, and the control means transmits the signal indicative of driving the nozzle recovery mechanism if the computed time elapsing period is equal to or greater than the predetermined period before actual printing operation.

22. The ink jet type image recording apparatus as claimed in claim 19, wherein the predetermined period comprises a first predetermined period and a second predetermined period greater than the first predetermined period, the control means controlling the nozzle recovery mechanism to be operated in a first mode if the computed time elapsing period is equal to or greater than the first predetermined period but is less than the second predetermined period and in a second mode if the computed time elapsing period is equal to or greater than the second predetermined period.

23. An ink jet type image recording apparatus to be used in combination with a host computer for forming an image on an image recording medium, the host computer including a clock means driven by an uninterruptible power supply, and memory means for storing a time counted by the clock means, the memory means also storing therein a printing timing, the ink jet type image recording apparatus comprising:

a main power supply means;

a print head having a plurality of nozzles through which ink is ejected for forming the image;

nozzle recovery mechanism for purging or flushing an interior of the nozzles of the print head;

a timer for counting a time elapsing period as a first period starting at a turning ON timing of the main power supply means or at a completion timing of a nozzle recovery operation by the nozzle recovery mechanism;

means for storing the first period;

means for storing a predetermined period;

means for receiving and storing a time elapsing period as a second period starting at a preceding printing timing which has been stored in the memory means; and control means connected to the timer, the recovery mechanism, and the storing means for operating the nozzle recovery mechanism prior to printing operation if one of the first and second periods whichever is longer exceeds the predetermined period.

24. The ink jet type image recording apparatus as claimed in claim 23, further comprising:

flag means rendered ON if the nozzle recovery mechanism is operated after turning ON the main power supply means, and rendered OFF if the nozzle recovery mechanism is not operated after turning ON the main power supply means, the control means being also connected to the flag means, the nozzle recovery mechanism being operated by the control means if one of the first and second periods whichever is longer exceeds the predetermined period if the flag means is rendered OFF, and the nozzle recovery mechanism being operated by the control means prior to printing operation if the first period exceeds the predetermined period if the flag means is rendered ON.

25. The ink jet type image recording apparatus as claimed in claim 24, further comprising selection means for selecting one of the first and second periods whichever is longer in order to compare the selected one of the period with the predetermined period.

26. The ink jet type image recording apparatus as claimed in claim 25, wherein the selection means comprises means for judging as to whether the first period is longer than the second period, and means for rewriting the second period into the first period if the second period is longer than the first period in the judgment by the judging means, the control means operating the nozzle recovery mechanism prior to printing operation if the rewritten period exceeds the predetermined period.

27. The ink jet type image recording apparatus as claimed in claim 26, further comprising reset means for resetting the timer after purging operation, so that the timer starts counting time from the completion timing of the nozzle recovery operation by the nozzle recovery mechanism.

28. An ink jet type image recording apparatus to be used in combination with a host computer for forming an image on an image recording medium, the host computer including a clock means driven by an uninterruptible power supply, the ink jet type image recording apparatus comprising:

a main power supply means;

a print head having a plurality of nozzles through which ink is ejected for forming the image;

nozzle recovery mechanism for purging or flushing an interior of the nozzles of the print head;

means for storing a completion timing of the latest purging or flushing operation by the nozzle recovery mechanism;

means for receiving and storing a present time instant as a second time instant from the clock means;

means for storing a predetermined period;

means for counting a time in response to turning ON timing of the main power supply means, the counting means counting time starting from the completion timing of the latest purging or flushing operation for indicating a first time instant;

means for computing a time elapsing period by subtracting the completion timing of the latest purging or flashing operation from the first time instant; and means for controlling an operation timing of the nozzle recovery mechanism, the control means having judging means where judgment is made as to whether or not the time elapsing period is greater than the predetermined period for starting operation of the nozzle recovery mechanism if the judgment falls yes.

29. The ink jet type image recording apparatus as claimed in claim 28, further comprising rewriting means by rewriting the second time instant into the first time instant if the first time instant is earlier than the second time instant.

30. An ink jet type image recording apparatus to be used in combination with a host computer for forming an image on an image recording medium, the host computer including a clock means driven by an uninterruptible power supply, the ink jet type image recording apparatus comprising:

main power supply means;

a print head having a plurality of nozzles through which ink is ejected for forming the image;

nozzle recovery mechanism for purging or flushing an interior of the nozzles of the print head;

first storage means for storing a completion time instant at which the latest purging operation is completed;

second storage means for storing a second time instant provided by the clock means of the host computer;

computing means for computing a time elapsing period from the completion time instant to the second time instant; and control means connected to the first storage means, the second storage means, and the nozzle recovery mechanism for operating the nozzle recovery mechanism if the computed time elapsing period is equal to or greater than a predetermined period.

31. The ink jet type image recording apparatus as claimed in claim 30, wherein the control means further comprises:

judging means for making judgment as to whether or not the computed time elapsing period computed in the computing means is a negative value; and recovery operation execution means for operating the recovery mechanism if the computed value is the negative value.

32. The ink jet type image recording apparatus as claimed in claim 31, wherein the second storage means stores the second time instant when printing operation is started, and the control means transmits a signal indicative of driving the nozzle recovery mechanism if the computed time elapsing period is equal to or greater than the predetermined period before actual printing operation.

33. The ink jet type image recording apparatus as claimed in claim 32, wherein the predetermined period comprises a first predetermined period and a second predetermined period greater than the first predetermined period, the control means controlling the nozzle recovery mechanism to be operated in a first mode if the computed time elapsing period is equal to or greater than the first predetermined period but is less than the second predetermined period and in a second mode if the computed time elapsing period is equal to or greater than the second predetermined period.

34. The ink jet type image recording apparatus as claimed in claim 1, wherein the judging means can determine the elapsed period from the last printing operation prior to turning the recording apparatus off and a time the recording apparatus is turned back on based upon an input from the clock means of the host computer.

35. The ink jet type image recording apparatus as claimed in claim 23, wherein the control means can determine the elapsed period from the last printing operation prior to turning the recording apparatus off and a time the recording apparatus is turned back on based upon an input from the memory means of the host computer.

36. The ink jet type image recording apparatus as claimed in claim 28, wherein the judging means can determine the elapsed period from the last printing operation prior to turning the recording apparatus off and a time the recording apparatus is turned back on based upon an input from the clock means of the host computer.

37. The ink jet type image recording apparatus as claimed in claim 30, wherein the control means can determine the elapsed period from the last printing operation prior to turning the recording apparatus off and a time the recording apparatus is turned back on based upon an input from the clock means of the host computer.

* * * * *